US005330004A

United States Patent [19]

Williams et al.

[11] Patent Number: 5,330,004

[45] Date of Patent: Jul. 19, 1994

[54] WELL TREATMENT METHOD AND APPARATUS

[75] Inventors: Robert M. Williams; Bob Davis, both of Hobbs, N. Mex.

[73] Assignee: WADA Ventures, Hobbs, N. Mex.

[21] Appl. No.: 21,578

[22] Filed: Feb. 24, 1993

[51] Int. Cl.[5] ..... E21B 43/00

[52] U.S. Cl. ..... 166/279; 166/107

[58] Field of Search ..... 166/279, 264, 268, 270, 166/275, 305.1, 311, 312, 105.1, 105.2, 105.3, 107-109

[56] References Cited

U.S. PATENT DOCUMENTS

| | | | |
|---|---|---|---|
| 2,055,515 | 9/1936 | Yarbrough . | |
| 3,547,194 | 12/1970 | Morine | 166/279 |
| 3,627,045 | 12/1971 | Lebourg . | |
| 3,660,287 | 5/1972 | Quattrini . | |
| 3,687,202 | 8/1972 | Young et al. . | |
| 3,712,378 | 1/1973 | Olivier . | |
| 3,722,594 | 3/1973 | Smith et al. | 166/279 X |
| 3,760,878 | 9/1973 | Peevey . | |
| 4,190,113 | 2/1980 | Harrison | 166/107 X |
| 4,464,268 | 8/1984 | Schievelbein . | |
| 4,478,285 | 10/1984 | Caldwell . | |
| 4,493,383 | 1/1985 | Williams et al. . | |
| 4,621,693 | 11/1986 | Caldwell et al. . | |
| 4,711,299 | 12/1987 | Caldwell et al. | 166/107 X |
| 4,934,457 | 6/1990 | Wallender . | |
| 5,131,466 | 7/1992 | Chacin et al. | 166/107 X |
| 5,147,149 | 9/1992 | Craig et al. | 166/107 X |

*Primary Examiner*—Thuy M. Bui

*Attorney, Agent, or Firm*—Burns, Doane, Swecker & Mathis

[57] ABSTRACT

A method of, and apparatus for, treating a well using a tool string is disclosed. The method includes the steps of supplying a predetermined amount of treatment fluid to the well; pumping fluid from the well and holding the fluid in the tool string; and releasing the treatment fluid from the tool string into the well. In a preferred embodiment, the method includes repeating the pumping and releasing steps until the well is adequately treated.

21 Claims, 2 Drawing Sheets 8
2
16
24
18
10
W
W
A
20
22
18
6
12
28b
14
W
A
100
94
102
96
104
A
28a
A
W
4

WELL TREATMENT METHOD AND APPARATUS

FIELD OF THE INVENTION

The present invention generally relates to a method and apparatus for treating a well with plugged or otherwise damaged production zones or perforations in the area immediately surrounding the well bore. The invention relates to a method and apparatus for repeatedly contacting the perforations in a well with a treatment fluid.

BACKGROUND AND SUMMARY OF THE PRESENT INVENTION

Most geological reservoirs are formed by porous rock formations which are saturated with fluids such as oil, gas, and/or water. The ease at which these fluids can be produced from such underground reservoirs depends, in part, upon the permeability of the formation containing the fluid. The permeability of the formation near the well bore is particularly important to the productivity of a well because fluid from throughout the reservoir must flow through a relatively small surface area, or "skin", at the face of the well bore. Since many well bores are also lined with a cemented casing pipe, flow from the reservoir may be further restricted at the face of the well bore by the effectiveness of the perforations through the casing and cement. It is therefore important to maintain the permeability of the formation near the well bore and, more particularly, in and around the perforations in any casing that may line the well bore.

A variety of factors may cause damage to the "skin" of the formation immediately surrounding a well bore. For example, pressure and/or temperature changes during production cycles of a well can significantly increase the deposition of various materials in and around the well bore. Paraffin waxes and other heavy hydrocarbon residues are common precipitates in oil and gas wells while assorted mineral scales, including gypsum and calcium carbonate, are often deposited in oil and water wells. Permeability near the well bore may also be affected by a variety of other factors including bacterial proliferation, casing corrosion, formation deterioration, and emulsive mixing of the oil, gas, and/or water.

Many different chemical agents, both preventative and remedial, have been developed in an attempt to treat the various causes of reduced permeability near the well bore. Although each of these agents can be shown to be quite effective at treating blockages in the laboratory, it has been found to be difficult, in practice, to repeat such successes in the field. The present invention addresses these practical difficulties that may be caused at least in part, by insufficient contact of the treating fluids with the formation skin. The present invention provides an advantageous method and apparatus for addressing these and other problems associated with conventional well treatment technologies.

U.S. Pat. No. 2,055,515 to Yarborough, discloses a conventional cleaning apparatus for perforated pipe and the like. FIG. 4 of Yarborough shows a cleaner which is adapted to slosh production fluids back and forth through perforations in a restricted area of a strainer pipe. In operation, the tool is lowered into the well until packing members are arranged on either side of a desired interval. A plunger rod is then reciprocated to alternately apply suction and pressure to the confined interval, thereby sloshes the well fluid back and forth through the perforations.

The packing members disclosed in Yarborough are problematic because they often fail to seal properly and can jam the tool inside the well bore. Furthermore, since devices like that disclosed in Yarborough merely slosh production fluids back and forth through the casing (the so-called "washing effect" described at page 4, first column, line 27 of Yarborough), they do not allow fresh chemical treatment fluids to be used to clean the perforations. Moreover, the amount of fluid displaced by the device which is disclosed in the Yarborough patent is limited by the length of the tool stroke.

U.S. Pat. No. 3,760,878 to Peevey discloses a tool which is connected to a lower end of a string of tubing for washing perforations in a casing. The tool has three cup type packers which, in operation, are placed so that the perforations to be washed are below the lower two packers. Cleaning fluid is circulated down the annulus through an upper port of the housing and out a lower port between the lower two packers where it flows into the perforations. The cleaning fluid returns through perforations which are below the lower packer and then flows up into the tubing into the interior of the tool. As with Yarborough, the Peevey tool is also problematic because it uses packers.

The present invention relates to a method of treating a well using a tool string including a pump. The method may include the steps of supplying a predetermined amount of treatment fluid to the well, pumping the treatment fluid from the well bore into the tool string, and releasing the treatment fluid from the tool string into the well.

The present invention also relates to a method of treating a well using a tool string including a pump and a dump valve. The method may include the steps of filling the tool with a treatment fluid, opening the dump valve to release the treatment fluid from the tool string back into the well bore, and reciprocating the tool string in order to pump the treatment fluid from the well bore into the tool string.

The present invention also relates to an apparatus for storing fluid from a well bore. The apparatus may include a tubing string, a reservoir for storing treatment fluid within the tubing string, openings in the tubing string at a lower portion of the reservoir, and means for selectively opening and closing said openings in the tubing string.

In a further aspect of the present invention, the apparatus may include a dump valve arranged above a formation interval which is to be treated. The dump valve may be opened in order to allow treatment fluid to flow out of the tubing and create turbulent mixing currents as the treatment fluid flows down the well bore and covers the perforations. A still further aspect of the present invention includes adding additional treatment fluid to periodically revitalize the fluid and create additional hydrostatic head for enhanced turbulence when a predetermined amount of treatment fluid flows into the formation.

BRIEF DESCRIPTION OF THE DRAWINGS

The invention will now be described with reference to the following drawings wherein like elements have been provided with like reference numerals and wherein.

DETAILED DESCRIPTION OF THE PREFERRED EMBODIMENTS

The present specification hereby incorporates, by reference, the subject matter of U.S. Pat. Nos. 4,478,285, 4,621,693, and 4,711,299. The various apparatuses which are disclosed in these U.S. Patents have been found to be useful as pumps in conjunction with the present invention. However, any suitable pump that can deliver fluid to a level above the tool of the present invention, which is preferably arranged above the level of the casing wall to be cleaned, is also acceptable.

The present method and apparatus may be used with oil, gas, and/or water wells. The present method involves arranging a suitable pump which is capable of delivering fluid from the well to a location in a drillstring or tubing which is above a dump valve tool of the present invention. It has been found suitable to use a pump connected in the lower portion of the tubing (or drill string) which can pump the fluid to a level above the pump and above a dump valve tool of the present invention which is preferably arranged above the pump.

U.S. Pat. Nos. 4,478,285, 4,621,693 and 4,711,299 disclose various suitable devices for pumping solids and undesirable liquids from a well bore. These devices generally use an elongated tool string including a pump for moving liquid and debris from the well bore into the interior of the string. The pump in these devices may include either a stationary hollow piston and a moving cylinder (as in the '693 patent) or stationary cylinder and a moving piston (as in the '285 patent). Check valves may be provided in the string above and below the pump in order to prevent downward flow through the string.

Figure 1:
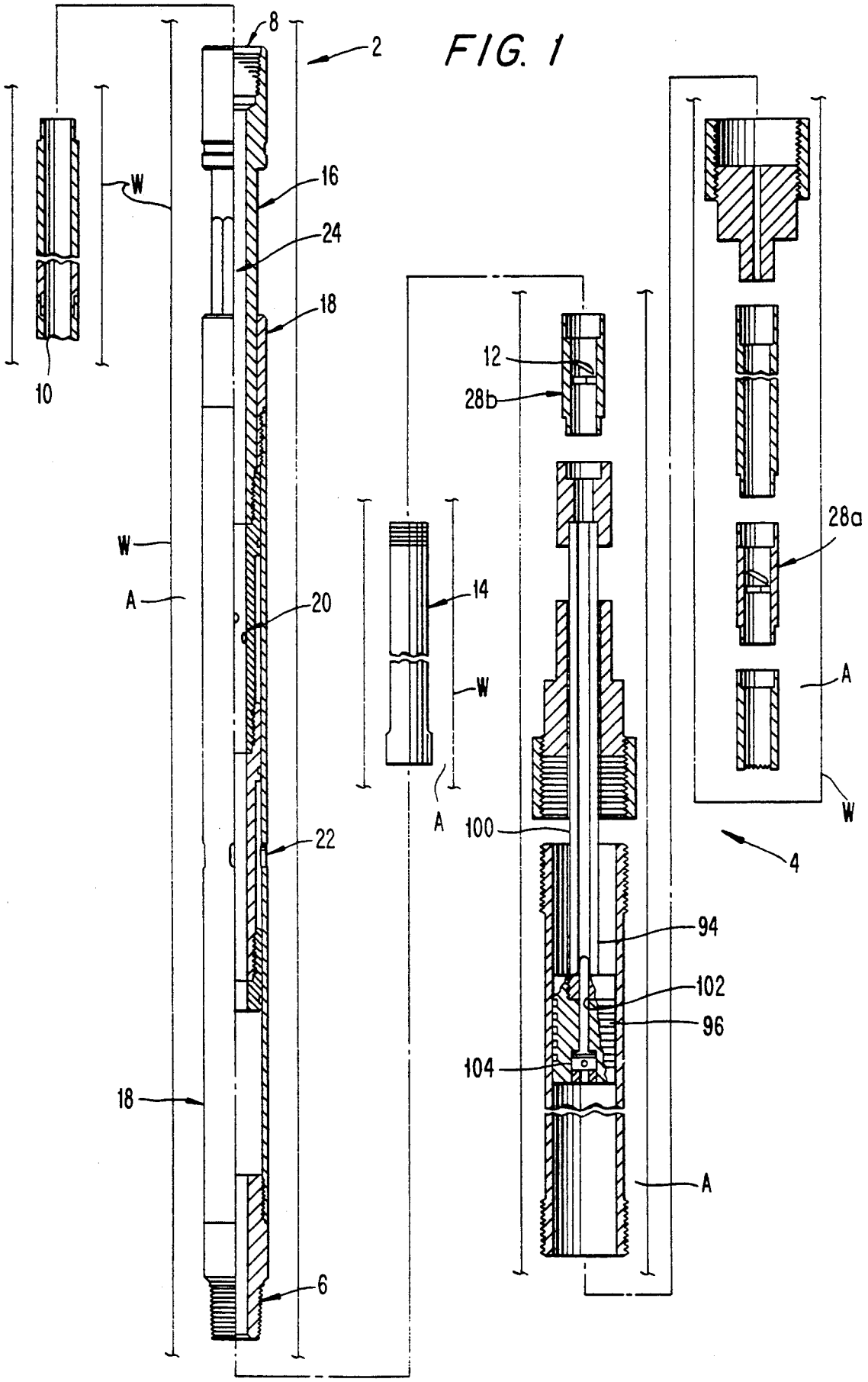
FIG. 1 is partial a cross-sectional view of a tool string arranged with a tool and one type of pump which may be suitable for use with the present invention.
Figure 2:
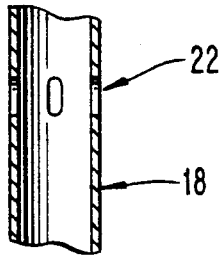
FIG. 2 is an enlarged cross-sectional view of a portion of the tool.
Figure 3:
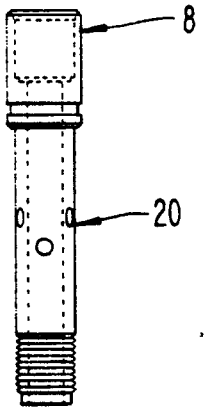
FIG. 3 is an enlarged view of another portion of the tool.

As illustrated in FIG. 1 the dump valve tool 2 of the present invention may be arranged in a wellbore W above a pump 4 and connected thereto by the lower threads 6 at one end of the dump valve tool 2. The upper threads 8 on the upper end of the tool 2 may be connected to a suitable length of tubing (or drillpipe) 10 which may hold any fluid that is pumped upward into the tubing 10 by pump 4. However, any other suitable means of conveying the tool string down a well bore, besides tubing 10, may also be used. The flap valve 12, which is shown in FIG. 1 as part of pump 4, may alternatively be provided in a lower portion of the dump valve tool 2.

One or more heavy connectors, such as drill collars 14, may be arranged on the tool string between the pump 4 and a dump valve tool 2. The drill collars 14 help provide a distinguishable weight to differentiate the stroking action of the pump 4 from the stroking action of the dump valve 2. By reciprocating the lower portion of the string (which includes the pump 4), liquid and/or debris may be pumped by the pump 4 from the well bore into the lower portion of the string and then into the upper portion of the string. As described in U.S. Pat. No. 4,478,285 the pump 2 includes a hollow piston rod 100 with a piston head 96 having a ball valve 104 to prevent downward fluid flow through interior passage 102. Liquid is pumped upwardly through the ball valve 104 and into the interior passage 102 of the piston 94 and piston rod 100 and then into the dump valve 2. Check valves or flap valves may be located in valve subs 28*a* and 28*b*. By reciprocating the entire string (including the dump valve 2 in the upper portion of the string), the dump valve 2 can be switched between open and closed positions as described in more detail below.

The dump valve tool 2 may include a mandrel 16 and a body 18. The mandrel 16 may include a set of openings (or ports) 20 which are alignable with a set of slots (or ports) 22 in the body 18. The openings 20 and slots 22 may take on a variety of shapes such as round or oval. Openings 20 may be in the form of two sets of three holes which are drilled 120 degrees apart and offset in order to maintain strength of the mandril 16.

When the dump valve tool 2 is in the compressed or open position, the openings 20 on the mandrel 16 are aligned with the slots 22 in the body 18 in order to permit fluid communication from the inside of the tubing 10 to the annulus between the tool string and the well bore. When the dump valve tool 2 is in an extended or closed position, i.e. when it is picked up in tension as illustrated in FIG. 1, the openings 20 and slots 22 are separated and sealed. The dump valve tool 2 may be alternatively moved between closed and open positions by setting down and lifting up on the tool string. The dump valve tool 2 could also be arranged to open when lifted and closed when set down by changing the relative positions of the ports 20 and 22.

When the dump valve 2 is in the closed position, the tubing 10 and mandril 16 above the openings 20 provide a reservoir 24 for retaining and storing fluid. When filled, the reservoir 24 provides hydrostatic head which aids in forcing the fluid rapidly outwardly through the ports 20, 22 near the bottom of the reservoir when the dump valve 2 is opened.

The dump valve tool 2 is preferably arranged in a tool string above the pump 4 and then run into the hole until the tool string tags bottom. It may be possible to arrange a dump valve tool 2 below the pump 4. In that arrangement, the dump valve would need to be configured to operate in the reverse manner, i.e., closed when set down.

The pump 4 may be pumped with its normal stroke while the dump valve 2 is held in the extended and closed (or sealed) position by the weight of the drill collars 14. When the dump valve 2 is closed, fluid from inside the well is pumped into and stored inside of the tubing 10 above the dump valve 2 in reservoir 24. The dump value 2 can then be opened by setting down on the tool string in order to allow fluid from inside the reservoir 24 to flow through the openings 20 and slots 22 into the well.

In accordance with a method of the present invention, a predetermined amount of treatment fluid may be supplied to the well bore either through the tubing 10 or directly into the annulus A. The amount of fluid delivered initially to the well bore will depend upon the type of treatment fluid being used and the problem being treated. The initial batch of treatment fluid may be only a portion of the total amount of treatment fluid which is finally delivered to the well bore.

The fluid may be placed in the well bore before (or after) insertion of the dump valve tool 2 and pump 4 into the well. The treatment fluid may also be supplied to the tubing 10 above the dump valve 2 and then delivered to the well bore in the annulus surrounding the string by setting down the string to open the dump valve 2 and allow fluid in the reservoir 24 to flow outwardly through the aligned openings 20 in the mandrel 16 and the slots 22 in the body 10.

The tool string may then be picked up to place the dump valve 2 in a closed position. The treatment fluid may be allowed to remain in the well bore for a length of time determined by the type of fluid being used and the type of problem that is being treated. While the dump valve tool 2 remains in the closed position, the string may be reciprocated within the stroke of the pump 4 in order to pump the fluid from the well bore up into the tubing 10 and reservoir 24. Care must be taken during the stroking of the pump 4 not to set down far enough on the down stroke to open the dump valve 2.

As the treatment fluid is pumped from the well bore, the fluid in the annulus will drop below the interval being treated and the formation may begin to produce fluid from the perforations to the well bore. As the stroking action of the pump 4 continues, the treatment fluid that was displaced into the perforations will eventually be recovered and pumped back into the tubing 10. Once it is calculated that a substantial portion of the initial batch of treatment fluid has been recovered back into the tubing 10 above the pump 4 and the dump valve 2, the tool string can be set down to open the dump valve 2 and dump the fluid back into the annulus in order to repeat the process. In this way, the hydrostatic head pushing the treatment fluid into the formation may be continuously changed.

The treating fluid can be dumped into the annulus and pumped back into the tool string over several cycles. For example, the treatment fluid could be released into the well and pumped into the tool string periodically, such as in 10 minute intervals. Each cycle, or wash, increases the probability that the treatment fluid will contact any foreign material in the vicinity of the well bore and will remove that material with a degree of turbulence and agitation caused by the dumping of the treatment fluid into the annulus. The extent of this turbulence and agitation is enhanced due to the presence of the reservoir 24 above the openings which provides increase in the hydrostatic pressure for forcing the treatment fluid from the tool string into the annulus.

After one or more cycles with the initial volume of treatment fluid, additional fresh treatment fluid can be added to the tubing (or annulus) in order to revitalize the treatment fluid. This repeated addition causes a "chain-link" effect whereby the first batch of fluid is forced by hydrostatic pressure into the formation followed by the next batch of fresh fluid which provides additional pressure against the first batch. Several additions of treating fluid can be made to the tubing in order to periodically revitalize the fluid being displaced. This repeated application of treatment fluid increases the likelihood that fresh treatment fluid (rather then previously used fluid) will directly contact the clogged formation openings. The periodic addition of small quantities of fresh treatment fluid has been found to be more expeditious in opening the formation than repeatedly pumping and releasing a larger amount of the same fluid.

Upon the completion of the selected number of cycles and additions of fresh treatment fluid, the treatment fluid may be completely pumped back into the tubing 10 with a continual pumping action of the pump 4. The tool string may then be removed from the well, with the spent treatment fluid, before the production equipment is put back into the well.

One example of a treatment method using the pump shown in U.S. Pat. No. 4,478,285 with the dump valve tool 2 will be described with reference to a well with a $5\frac{1}{2}''$ casing, a $2\frac{3}{8}''$ tubing string inside the casing, and a producing formation with a reservoir pressure of 200 psi capable of supporting a static fluid column of 460 feet. The tool string is first run to the bottom of the well and twenty barrels of a treatment fluid, such as xylene, is dumped down the tubing. Alternatively, the treatment fluid may be dumped down the annulus. The twenty barrels of treatment fluid will fill approximately 5160 feet of the $2\frac{3}{8}''$ tubing string.

Upon opening the dump valve 2, the twenty barrels of fluid in this example will fill approximately 1091 feet of the tubing-casing annulus, far exceeding the static fluid level that the reservoir pressure will support. The fluid will thus be hydraulically displaced into the perforations until the hydrostatic pressure of the fluid in the annulus matches the formation pressure near the well bore. Approximately all 20 barrels of fluid would be expected to be displaced into the perforations in this example. Approximately 200 strokes of the pump would be required to recover these twenty barrels of fluid.

The basic method of repeatedly dumping treating fluid into the production interval and pumping the fluid back into the tubing lends itself to many variations in the sequence, frequency, and/or duration of the cycles being employed along with variations in the types of treating chemicals and solvents which may be used. Continual cycling (i.e. pumping and releasing) of the same fluid helps agitate and increase the likelihood of treatment fluid making contact with desired portion of the well. Releasing the fluid from above the portion of the well to be treated further creates helpful turbulence and agitation in the fluid column in the annulus as turbulent currents are agitated against the well bore when the treatment fluid falls down the well. Adding new fluid after a cycle will revitalize the treatment fluid and help to force the previous batch of fluid further into the formation under increased hydrostatic head. All of these advantageous effects may be realized without removing the string from the well bore thereby saving large amounts of time for the treating operation.

The foregoing has described the principles, preferred embodiments and modes of operation of the present method and apparatus. However, the invention should not be construed to be limited to the particular embodiments discussed above. Instead the embodiments discussed above should be regarded as illustrative rather than restrictive and it should be appreciated that variations may be made without departing from the scope of the present invention as defined by the following claims.

What is claimed is:

1. A method of treating a well using a tool string including a pump, comprising the steps of:

supplying a predetermined amount of treatment fluid to the well;

pumping fluid from the well and holding the fluid in the tool string; and releasing the treatment fluid from the tool string into the well.

2. A method as claimed in claim 1, wherein during said supplying step the well is filled to a level above a producing zone in the formation so as to force the treatment fluid into the formation.

3. A method as claimed in claim 1, wherein said pumping step includes reciprocating the tool string.

4. A method as claimed in claim 1, wherein said releasing step includes moving the tool string in order to open a dump valve arranged in said tool string.

5. A method as claimed in claim 4, wherein said dump valve is arranged in said tool string above a producing formation in the well.

6. A method as claimed in claim 5, wherein said treatment fluid is released from a height sufficiently above a portion of the well to be treated in order to create turbulent flow in the well.

7. A method as claimed in claim 1, further comprising the step of supplying additional treatment fluid to the string, said additional treatment fluid to be released after said pumping step.

8. A method as claimed in claim 1, wherein the treatment fluid is supplied to the well from the tool string.

9. A method as claimed in claim 7, further comprising repeatedly adding more treatment fluid after successive pumping steps.

10. A method as claimed in claim 1, further comprising the step of collecting the treatment fluid in a reservoir and wherein the release of fluid is from a lower portion of said reservoir.

11. A method as claimed in claim 1 wherein during said supplying step, the treatment fluid is forced into the well by a hydrostatic head.

12. A method as claimed in claim 1, further comprising the step of permitting the treatment fluid to remain in contact with a face of the well for a predetermined time prior to the pumping step.

13. A method as claimed in claim 1, further comprising repeating said pumping and said releasing steps.

14. A method of treating a well using a tool string including a pump and a dump valve, comprising the steps of:

supplying the tool with a predetermined amount of treatment fluid;

opening the dump valve to release the treatment fluid from the tool string back into the well bore; and reciprocating the tool string in order to pump the treatment fluid from the well bore into the tool string.

15. A method as claimed in claim 14 further comprising opening the dump valve to release the treatment fluid after the treatment fluid has been pumped into the tool string.

16. A method as claimed in claim 15, wherein said reciprocating step and said opening step are repeated at least two times.

17. A method as claimed in claim 15, further comprising the step of filling the tool with additional treatment fluid to be released after said pumping step.

18. An apparatus for storing fluid from a well bore and returning the fluid to the well bore, comprising:

a tubing string;

a reservoir for storing treatment fluid within the string;

openings in said tubing string at a lower portion of the reservoir; and means for selectively opening and closing said openings to release treatment fluid from said reservoir into the well bore.

19. An apparatus as claimed in claim 17, wherein said means for selectively opening and closing said openings includes a mandrel which slides inside a mandrel body.

20. An apparatus as claimed in claim 17, further comprising means for connecting said apparatus to a pump for delivering fluid to the reservoir.

21. An apparatus as claimed in claim 17, further comprising check valve means for retaining fluid in said reservoir.

* * * * *